United States Patent [19]

Thomassen

[11] Patent Number: 4,954,104

[45] Date of Patent: Sep. 4, 1990

[54] PRESS-FIT ELECTRICAL TERMINAL

[75] Inventor: Egidius T. R. Thomassen, Maren-Kessel, Netherlands

[73] Assignee: E. I. du Pont de Nemours and Company, Wilmington, Del.

[21] Appl. No.: 477,179

[22] Filed: Feb. 8, 1990

Related U.S. Application Data

[63] Continuation of Ser. No. 328,882, Mar. 27, 1989, abandoned.

[30] Foreign Application Priority Data

Nov. 30, 1988 [NL] Netherlands ..... 8802705

[51] Int. Cl.[5] ..... H01R 13/41

[52] U.S. Cl. ..... 439/751; 29/379; 439/84

[58] Field of Search ..... 439/82, 84, 751, 876; 29/876, 879

[56] References Cited

U.S. PATENT DOCUMENTS

| | | | |
|---|---|---|---|
| 4,017,143 | 4/1977 | Knowles | 339/221 |
| 4,186,982 | 2/1980 | Cobaugh et al. | 339/17 |
| 4,274,699 | 6/1981 | Keim | 339/176 |
| 4,464,009 | 8/1984 | Thaler | 339/252 |
| 4,469,394 | 9/1984 | Verhoeven | 439/873 |
| 4,684,203 | 8/1987 | Bihler | 439/751 |
| 4,728,164 | 3/1988 | Lemmens et al. | 439/870 |

*Primary Examiner*—Eugene F. Desmond

[57] ABSTRACT

An electrical contact terminal having a mounting section designed for press-fit insertion into a hole of a substrate such as a circuit board. The mounting section comprises an oblong base portion to which is secured at least one separately formed flexible fin. While the base portion and fin are both electrically conductive, they are not formed integrally from the same material and may be formed of two different materials. The fin or fins are secured to opposite sides of said base portion and are secured to said base portion at one or both ends. At one end, the fins are narrowed in width and thickness and secured to the base portion by means of electrical or laser welding. The fins may be mechanically clamped to the base portion at the other end. The terminals may be carried by a carrier strip and the fins may be preferably formed by punching a portion of said carrier strip and bending it around said base portion of the terminal to form parallel fins extending on opposite lateral sides of the base portion. A process for manufacturing the electrical terminal is also disclosed.

7 Claims, 1 Drawing Sheet

PRESS-FIT ELECTRICAL TERMINAL

This application is a continuation of application Ser. No. 07/328,882 filed 3/27/89, now abandoned.

BACKGROUND OF THE INVENTION

The present invention relates generally to an electrical contact for press-fit mounting in a plated-through hole in a printed circuit board substrate and, more particularly, to an electrical contact with a mounting section having an oblong base portion and one or more flexible fins attached to the circumference of and extending in the longitudinal direction of the base portion and a method for making such a contact.

Electrical contacts which are press-fit mounted in plated-through holes of printed circuit boards without need for soldering have become widely used in the electronics industry. Such electrical contacts are commonly referred to as press-fit terminals. Examples of such press-fit terminals are the H-shaped press-fit pin manufactured by the assignee of the present application and disclosed, for example, in U.S. Pat. No. 4,728,164 granted Mar. 1, 1988; the "Bow-Tie" press-fit pin, also manufactured by the assignee of the present application and disclosed, for example, in U.S. Pat. No. 4,274,699 granted Jun. 23, 1981; the "Action Pin", manufactured by AMP and disclosed, for example, in U.S. Pat. No. 4,186,982; and the "C-press" pin manufactured by the Winchester Electronics Division of Litton Systems, Inc. disclosed, for example, in U.S. Pat. No. 4,017,143 granted Apr. 12, 1977.

U.S. Pat. No. 4,728,164 noted above discloses an electrical contact pin for mounting in the plated-through holes of a printed circuit board through compliant press-fit action. The mounting section has an H-shaped cross-section which comprises four compliant fins and a central crossbar. The contact pin is made from square wire or flat strip material and its H-shaped mounting section is formed by stamping or other suitable mechanical deformation techniques. The fins are therefore formed integrally with and are of the same metal as the crossbar, having been forced outward or extruded during stamping.

U.S. Pat. No. 4,464,009 granted Aug. 7, 1984 describes a solderless contact pin wherein the deformable mounting section is M-shaped or W-shaped. The mounting section is also formed by stamping and consists of two elongated beam members interconnected integrally to one another by a cross-member.

Insertion and retention of a press-fit terminal in place in a circuit board hole requires very accurate dimensioning of the mounting seciton. This is of great importance. If the mounting section is too small compared to the opening of the substrate, the electrical contact with the metallized wall of a plated-through hole may be unreliable. Also, the retention force applied to the wall of the hole to keep the terminal in place may not be sufficient. On the other hand, too large a mounting section may cause serious damage to the metallized layer of the wall in the hole and consequently also lead to an unreliable electrical connection. It may cause twisting or shifting during mounting of the terminal in relation to the desired position.

The requirements for accurate dimensioning become even more critical when the size of the opening of the substrate decreases. In practice, it has become evident that the prior art electrical contacts with mounting sections produced by mechanical deformation such as stamping are inadequate for smaller hole dimensions unless one is willing to accept a relatively high waste percentage. It should be pointed out that accurate dimensioning of the mounting section is always necessary to achieve the required firm mechanical mounting and, if applicable, also a reliable electrical connection.

Rather than a mounting section of integrally formed members deformed through stamping and the like, U.S. Pat. No. 4,684,203 granted Aug. 4, 1987 discloses an electrical contact pin wherein one or two separate contact springs are attached to one or two lateral surfaces of the base pin. The mounting section of the base pin is flattened by pressing to provide two opposite flat surfaces. Separately formed and outwardly curved contact springs are then attached to each flat surface by welding one end of each contact spring to the base pin. The contact springs extend longitudinally along the length of the base pin and are outwardly curved or convex so that each is furthest from the flat lateral surface of the pin at the spring's mid-point. The contact springs are subjected to bending stress as the convex curve is forced by the hole wall to flatten against the flat lateral surfaces of the contact pin as the latter is inserted into the printed circuit board hole. This patent discloses that its contact pin package is designed for holes having a nominal diameter of 0.889 mm to 1.143 mm (0.035"to 0.045"), or approximately the maximum range of conventional printed circuit board holes, which typically have a nominal diameter of about 0.040 inches or about 1 mm.

SUMMARY OF THE INVENTION

Smaller size holes are becoming more important as the density of printed circuit boards increase. Many new connector devices have pitch distances of 0.050 inches or about 1.27 mm with hole diameters of 0.024 inches or 0.6 mm. The present invention is designed and intended for such smaller holes. The need for very accurate dimensioning of the mounting section is particularly critical for such small size holes. It is especially important that the insertion forces by sufficiently low to avoid damaging the plated-through metallization in the hole yet the retention forces sufficiently high to achieve a gas-tight seal and a good electrical connection and to retain the contact pin in the hole without soldering.

The present invention provides an electrical terminal with a contact mounting section which can be accurately dimensioned for practical press-fit mounting in a plated-through hole of a printed circuit board. This is accomplished according to the invention by providing separately formed fins of thin flat metal strips or lamellae which are individually attached to the base portion.

By using individual, separately formed fins according to the invention, the dimensionally inaccurate stamping operation for the production of the fins integrally with contact pin itself as disclosed in the aforenoted U.S. Pat. No. 4,728,164 is eliminated. The fins according to the invention can be produced with a dimensional accuracy desired for practical applications by punching or by a suitable mechanical machining technique from sheet material. Seen technologically, the invention has the further advantage that different metal materials can be used for the terminal base portion and the fins, thus enabling optimization of the material properties of both during manufacture and use. This is not possible with many of the terminals of the prior art wherein the entire mounting section is integrally formed by a stamping operation.

In one embodiment of the present invention, the base portion of the mounting section has an approximate elliptical cross-section with the fins attached to the sides with the largest radius of curvature. When mounting the terminal in cylindrical openings, the elliptical cross-section, appropriately dimensioned together with the thickness and width of the fins, has the advantage that in the longitudinal direction of the base portion, there are spaces provided betrween the fins and base portion. When the terminal is inserted, the fins are bent downward toward the base portion to fill these spaces and the mounting section deforms to achieve an almost round cross-section adapted to the shape of the opening.

The mounting section may be located at one end of the terminal. When the latter is pin-shaped, the mounting section may also be located at a distance from the ends. In either case, the flexible fins change shape and deform to the shape of the hole, thereby applying a force in the hole wall so to anchor the contact firmly in place when the mounting section is inserted into the hole.

In a preferred embodiment of an electrical contact according to the present invention, the fins run parallel or almost parallel to each other on opposite sides of the base portion and have the same or almost the same width and thickness. The use of a symmetrically designed mounting section permits fins to bend uniformly near their longitudinal edges and engage with the wall of the opening. This effectively prevents a twisting or eccentric mounting of the contact which is especially important when the contacts are arranged in a row of a connector.

To promote further the accurate positioning and dimensioning of the contact, another embodiment of the present invention provides that the base portion is flattened at least over a portion of its circumference on each side where a fin is attached. A longitudinal midsection of each fin is disposed adjacent the flattened section while longitudinal edges of each fin remains free. The flattened sections of the base portion promote the deformation of the fins as much as possible only near their longitudinal edges, which promotes press-fit action.

To minimize damage of the metallized wall of a plated-through hole of a printed circuit board, an embodiment of the invention provides that the longitudinal edges of the fins are rounded off on the side facing the hole wall and away from the base portion. To facilitate further the insertion into the hole, a further embodiment of the invention provides that the fins are narrowed down to have reduced width and thickness at one end in the direction towards the base portion. This narrowed end forms the forward insertion end of the mounting section.

It is apparent that when the fins are attached only to the base portion near their ends, the construction is sufficiently mechanically firm for mounting purposes. In order to disturb as little as possible the shape of the mounting section suitable for the insertion of the contact in an opening, a still further embodiment of the invention provides that the fins are attached to the base portion by soldering or welding them to the base portion at the narrowed end. Preferably, the fins may be electrically welded or laser welded to the base portion. The fins may then be simply clamped around the base portion at their other end.

Since the fins according to the invention need not necessarily be formed from the same material as the contact per se, the invention further offers the possibility for an optimum material choice for the contact and the fins adapted to specific requirements. For example, the contact may be produced from a material having desired electrically conductive properties while the fins may be made of material having certain bending characteristics and a certain spring action.

In an embodiment of the invention particularly suitable for mounting in relatively small openings, the contact is produced from an electrically conductive material having a greater mechanical strength than the material of the fins. The advantage of this embodiment resides in that, in spite of the relatively small dimensions, the contact can be produced with sufficient mechanical strength as a result of a suitable choice of material so that it does not bend or otherwise deform when inserted in an opening. On the other hand, the fins may be produced from a material having mechanical strength properties which permit their bending during the insertion in an opening and thus adapted to the specific circumstances. A specific embodiment of the invention provides that the main contact body is formed of brass and the fins of phosphor bronze or an alloy of beryllium and copper.

The present invention also relates to a process for making the electrical contact described above with a mounting section for mounting in an opening of a substrate wherein the contact is locally provided with an oblong base portion by means of a mechanical treatment, after which one or more fins are attached to the circumference of the base portion.

The preferred embodiment of this process provides that the contact is positioned with the base portion in the direction perpendicular to the longitudinal edge of a carrier strip and in that a fin is produced from the carrier strip on both sides of the base portion in such a way that it remains connected to the carrier strip via a transfer edge. The fins can be produced economically by punching from the material of the carrier strip.

When several contacts are to be inserted simultaneously in corresponding openings of a substrate, it is advantageous from a mounting viewpoint to provide a carrier strip with several contacts, each provided with a mounting section attached to this carrier strip, which is removed only after the contacts have been inserted, for example, by breaking off at the above-mentioned transfer edge.

BRIEF DESCRIPTION OF THE DRAWINGS

The invention is further explained in more detail by means of preferred embodiment shown in the drawings.

DESCRIPTION OF THE PREFERRED EMBODIMENT

Figure 1:
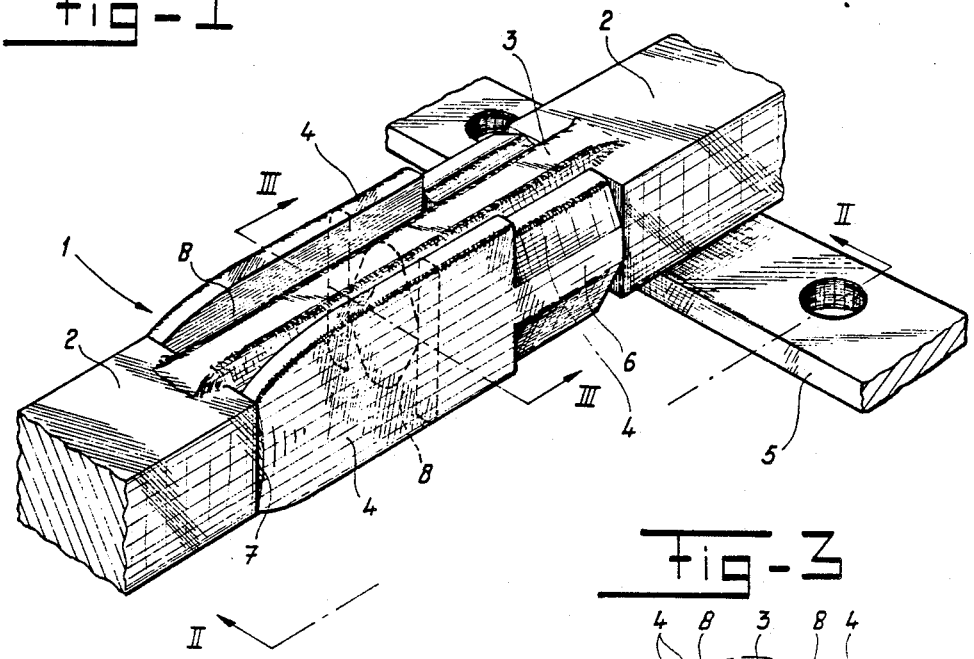
FIG. 1 perspectively shows a view of the mounting part of an electrical contact element according to the invention attached to a carrier strip.

FIG. 1 shows a preferred embodiment of the press-fit mounting section of an electrical contact according to the invention wherein the mounting section as a whole is illustrated and designated with the reference number 1. The contact may have any shape known or used in the art such as a pin contact, bus contact, plug contact, or the like, or their combinations (not shown). The mounting section 1 can be located at one end of the contact or between its ends.

Starting from a square wire 2 of electrically conductive material, an oblong base portion 3 having an approximately angular elliptical cross-seciton is formed, for example, by stamping whereby the contours are indicated by a dashed line at the location of the desired mounting section 1. The sides of the base portion 3 with the largest radius of curvature are flattened at least in the center in longitudinal direction over a portion of the circumference. Against these flattened portions, two identical oblong flat rectangular fins 4 are provided running parallel to each other in such a way that the mounting section 1 has a symmetrical cross-section. The fins 4 originate from the carrier strip 5 in the direction perpendicular to the longitudinal edge of the wire 2. In other words, the flat carrier strip 5 provides the flat metal strips from which the fins are formed. This material may be purchased from the carrier strip and bent up so as to stradle opposite sides of the base portion 4, thus providing fins 4.

At the end 6 of the base portion 3 located near the carrier strip 5, the fins 4 are appropriately clamped down to the base portion 3. At the other end 7 of the base portion 3, the fins 4 are formed with reduced thickness, narrowing down in width as well as in thickness towards the base portion for easier insertion of the mounting section 1 in an opening. In order to maintain this shape as much as possible, the fins 4 are welded in place near this narrow end 7 of the base portion 3, preferably by means of a laser beam or electrically. The fins 4 define in relation to the circumference of the base portion 3 spaces 8 in its longitudinal direction. In order to further facilitate the insertion of the contact in an opening to prevent damage to the wall of the opening as much as possible, the longitudinal edges of the fins 4 are rounded off on the side facing the wall of the opening and away from the base portion 3. The contours of the cross-section of the fins 4 are also shown in FIG. 1 by the dashed lines.

Figure 2:
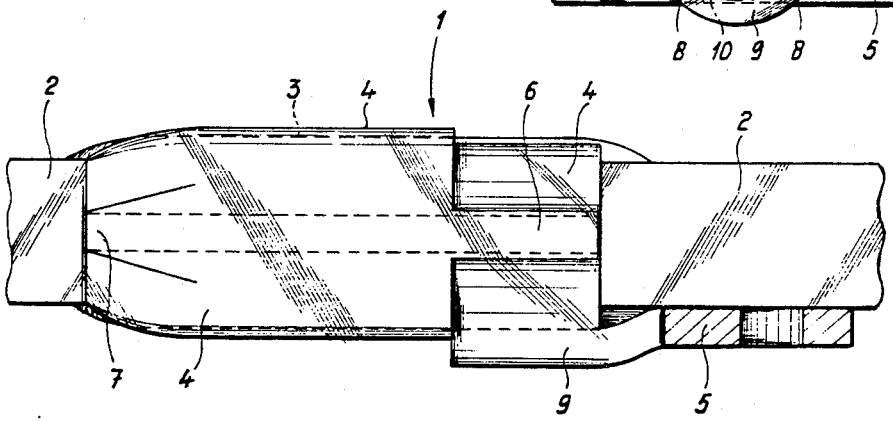
FIG. 2 shows a longitudinal view of the mounting part along line II—II in FIG. 1.

FIG. 2 shows a longitudinal view along line II—II of the mounting section shown in FIG. 1. The fins 4 which are formed, for example, by punching from a carrier strip 5 are still connected to the carrier strip 5 via a transfer edge 9. The material forming the fins 4 therefore surround the base portion 3 at its end 6 on three sides, with the transfer edge 9 along the bottom. Since the fins 4 are clamped at the end 6 around the base portion 3, the contacts consequently remain attached to the carrier strip 5 via bottom edge 9. From a mounting viewpoint, this is advantageous since several contact elements having a mutual distance or pitch corresponding to the mounting holes in a substrate can then be mounted together simultaneously while attached to the carrier strip.

Figure 3:
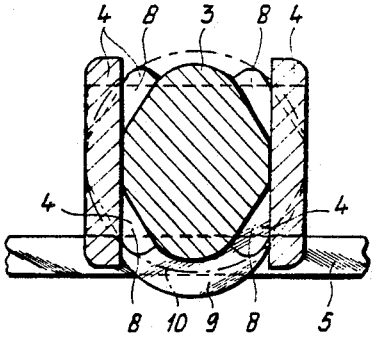
FIG. 3 shows a cross-section of the mounting part along line III—III in FIG. 1 in which the situation in mounted state is indicated with interrupted lines.

FIG. 3 shows a cross-seciton of the mounting section along the line III—III of FIG. 1. Dashed lines show the situation in which the mounting section is accomodated in a cylindrical opening 10 in a substrate. This clearly shows the flattening of the base portion on the side where the fins are attached and the need for the spaces 8 to accomodate the bent longitudinal edges of the fins 4 formed between the circumference of the base portion 3 and the fins 4 in longitudinal direction of the base portion 3.

With the illustrated embodiment, contacts can be provided for a reliable and mechanically firm mounting in substrate openings having a diameter in the order of magnitude of 0.6 mm or less. In mounting contact elements with a pitch distance of 1.27 mm (0.050") and openings of 0.6 mm (0.024"), square wires 0.4 mm wide on a side with fins 0.6 mm wide and having a thickness of 0.12 mm can be used. Fins having such dimensions can readily be produced from rolled sheet material with a tolerance of only several micrometers. It is extremely difficult to achieve such tolerances by stamping. Quite obviously, both larger and smaller dimensions are possible, adapted to the specific dimensions of the mounting opening.

Since the contact's mounting section comprising the square wire and the fins can be selected of different material, it is possible, in contradistinction with currently available press-fit terminals made from one type of material by stamping, to readily meet special requirements in relation to electrical and mechanical properties. A preferred choice of material is a contact made of brass which provides for a sufficient mechanical strength and electrical conductivity and fins made of phosphor bronze or an alloy of beryllium and copper which have the desired spring characteristics and bending properties for an easy and firm mounting in an opening of a substrate.

The invention is not limited to the demonstrated and discussed preferred embodiments but can be provided in different variations, for example, with more than two fins disposed along the circumference of the base portion with fins twisted in longitudinal direction in relation to each other, with a base portion having a cross-section deviating from the shown angular elliptical shape, etc. The use of square wires as a starting material of course is not a necessity and neither is the provision of the contact mounted on a carrier strip. The fins may, for example, be welded or soldered over their entire length to the base portion or be clamped, welded or soldered at both ends. Other variations and modifications are possible without departing from the spirit and scope of the present invention.

I claim:

1. An electrical contact terminal for press-fit insertion into an opening in a substrate such as a circuit board wherein said terminal has a mounting section comprising an oblong base portion having an approximately elliptical cross-section and two separately formed flexible fins extending lengthwise in contact with two opposite surfaces of said base portion with the largest radius of curvature, said opposite surfaces being flattened in the area contacting the fins so that a longitudinal mid-section of each fin extends in contact with each said flattened opposite surfaces of the base portion and a longitudinal free edge of each said fin extends away from said base portion, each said edge being rounded on a side facing away from the base portion, said fins being tapered and welded to the base portion at one end and clamped to the base portion at the other end.

2. An electrical contact terminal according to claim 1 wherein the fins are each welded at their tapered end to the base portion by electrical or laser means.

3. An electrical contact terminal according to claim 1 wherein said fins are formed by punching metal material from a carrier strip which carries a plurality of said terminals, each terminal provided with a said mounting section.

4. An electrical contact terminal according to claim 1 wherein the base portion is formed from one electrically conductive material and said fin is formed from a second electrically conductive material.

5. An electrical contact terminal according to claim 4 wherein said first material is brass and said second material is either phosphor bronze or an alloy of beryllium and copper.

6. A process for making an electrical contact terminal comprising the steps mechanically forming an oblong base portion of said terminal for a distance along said terminal's length and attaching two separately formed flexible fins to contact opposite surfaces of said base portion extending in its longitudinal direction, said contact terminal being secured to a carrier strip and extending in a direction perpendicular to the carrier strip and said two fins being formed from the material of the carrier strip by punching material of the carrier strip on both sides of the formed terminal, tapering one end facing away from the carrier strip and bending said material to straddle and contact opposite sides of the terminal, said fins being thereafter secured to the base portion of the terminal at their tapered end by welding and secured to the base portion at the other end adjacent the carrier strip by clamping a portion of said fins around the base portion, said base portion and fins comprising a mounting section for press-fit mounting of said terminal into an opening of a substrate such as a circuit board.

7. A process according to claim 6 wherein the fins are welded to said base portion either electrically or by means of a laser beam.

* * * * *